US006138289A

United States Patent [19]

Sardo

[11] Patent Number: 6,138,289

[45] Date of Patent: Oct. 31, 2000

[54] AUTOMATIC TOILET SEAT LOWERING DEVICE

[76] Inventor: Dominic Sardo, 1340 Capistrano Blvd., Glendale, Calif. 91208

[21] Appl. No.: 09/503,237

[22] Filed: Feb. 11, 2000

[51] Int. Cl.[7] ..... A47K 13/04

[52] U.S. Cl. ..... 4/248; 4/246.1; 4/246.2

[58] Field of Search ..... 4/241, 246.1, 248, 4/246.2–246.5, 250; 267/118, 120, 122; 49/137, 138; 220/264, 827, 831, 263

[56] References Cited

U.S. PATENT DOCUMENTS

| | | | |
|---|---|---|---|
| 2,842,779 | 7/1958 | Zulkoski | 4/246.2 |
| 4,577,350 | 3/1986 | Clark | 4/251 |
| 4,853,983 | 8/1989 | Grant | 4/251 |
| 4,887,322 | 12/1989 | Lydon | 4/248 |
| 5,029,347 | 7/1991 | Lin | 4/246.2 |
| 5,101,518 | 4/1992 | Phillips | 4/251 |

FOREIGN PATENT DOCUMENTS

| | | | |
|---|---|---|---|
| 48806 | 6/1988 | Germany | 4/248 |

*Primary Examiner*—Henry J. Recia
*Assistant Examiner*—Tuan Nguyen
*Attorney, Agent, or Firm*—Goldstein & Canino

[57] ABSTRACT

A toilet seat lowering system, for use with a toilet seat having a seat bottom and a seat rear which is mounted upon a toilet bowl, comprising a top plate and a bottom plate. The top plate and bottom plate are mounted between the toilet seat and toilet bowl near the bowl rear, wherein the top plate is pivotally connected to the seat bottom, and the bottom plate is pivotally connected to the bowl. The top plate is hingeably mounted to the bottom plate near the seat rear. Bellows, having an internal cavity, is located between the top plate and bottom plate. An intake valve and a slow release valve are in communication with the internal cavity of the bellows. When the toilet seat is manually lifted from its initial lowered position to a raised position, air is drawn into the internal cavity through the intake valve, pressurizing the internal cavity and thus maintaining the toilet seat in the raised position. After a period of time, air escapes through the slow release valve, causing the toilet seat to return to the lowered position automatically.

7 Claims, 4 Drawing Sheets

AUTOMATIC TOILET SEAT LOWERING DEVICE

BACKGROUND OF THE INVENTION

The invention relates to an automatic toilet seat lowering device. More particularly, the invention relates to a system for lowering a toilet seat within a short period of time after the seat has been manually raised.

Conventional toilets are fitted with a hinged seat. The seat remains in the lowered position most of the time, but is raised by males when urinating. However, inevitably many males forget to lower the seat after using the toilet. Often then, a confrontation occurs between that male and the next female who seeks to use the toilet.

Because this situation is so pervasive, many have proposed solutions. These solutions include numerous electronic devices which try to alert the male user, and "remind" him to lower to seat. However, others have proposed devices which seek to directly deal with the problem by actually lowering the seat.

U.S. Pat. No. 5,101,518 to Phillips discloses an automatic lowering device which proposes a variety of schemes for lowering the toilet seat after a predetermined period of time. One such scheme involves a pair of reservoirs which hold a quantity of fluid. Timed fluid flow between the reservoir, in theory, causes the toilet seat to lower after a period of time.

U.S. Pat. No. 2,842,779 to Zulkosi discloses an operator for a toilet seat which uses a foot pedal to pneumatically lift and lower the toilet seat.

U.S. Pat. No. 4,853,983 to Grant discloses a mechanized toilet seat which attaches at the seat hinge, and employs two inflatable rubber bags to either raise or lower the seat, under the control of a foot pedal.

While these units may be suitable for the particular purpose employed, or for general use, they would not be as suitable for the purposes of the present invention as disclosed hereafter.

SUMMARY OF THE INVENTION

It is an object of the invention to produce a device which maintains a toilet seat in the upright position for a short period of time, and then returns the toilet seat to the lowered position immediately thereafter.

It is another object of the invention to provide a device which is simple to use, requiring that the user have no special knowledge of its operation, and not requiring that the operator remember to initiate its operation in any way. Accordingly, the device engages when the toilet seat is manually lifted, and will operate as intended—slowly lowering the seat—unless the user manually pushes the toilet seat downward.

It is another object of the invention to provide a device which is inexpensive to manufacture. Accordingly, the device has a simplistic design—eliminating the complexity present in other devices intended to serve similar purposes.

It is another object of the invention to provide a device which is easy to install. Accordingly, its simplistic construction allows it to be quickly and easily retrofitted to existing toilets.

The invention is a toilet seat lowering system, for use with a toilet seat having a seat bottom and a seat rear which is mounted upon a toilet bowl, comprising a top plate and a bottom plate. The top plate and bottom plate are mounted between the toilet seat and toilet bowl near the bowl rear, wherein the top plate is pivotally connected to the seat bottom, and the bottom plate is pivotally connected to the bowl. The top plate is hingeably mounted to the bottom plate near the seat rear. Bellows, having an internal cavity, is located between the top plate and bottom plate. An intake valve and a slow release valve are in communication with the internal cavity of the bellows. When the toilet seat is manually lifted from its initial lowered position to a raised position, air is drawn into the internal cavity through the intake valve, pressurizing the internal cavity and thus maintaining the toilet seat in the raised position. After a period of time, air escapes through the slow release valve, causing the toilet seat to return to the lowered position automatically.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figures 1, 2:
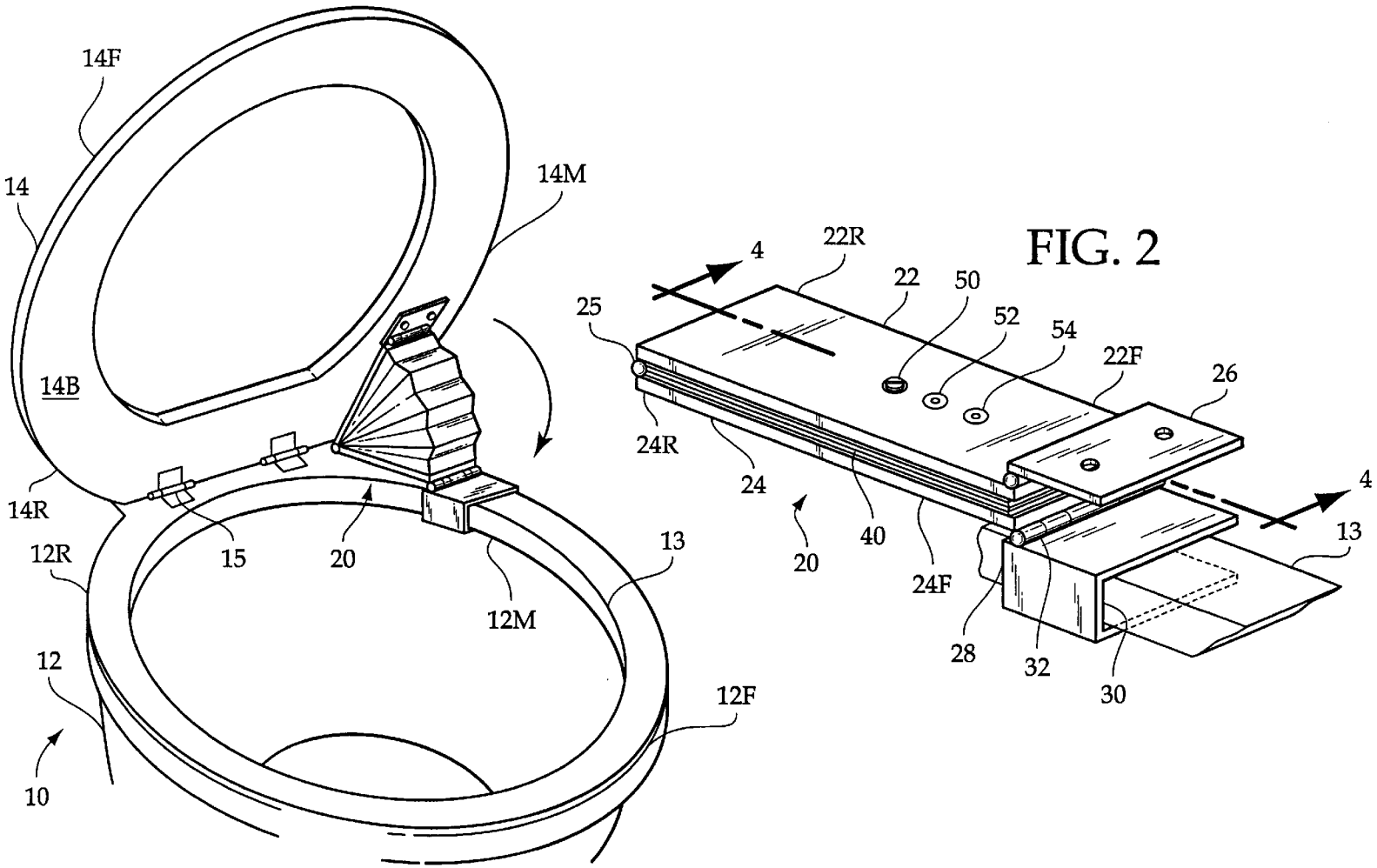
FIG. 1 is a diagrammatic perspective view, illustrating the present invention mounted in place between a toilet seat and a toilet bowl.
FIG. 2 is a diagrammatic perspective view of just the invention, wherein the bellows of said invention is fully deflated.

FIG. 1 illustrates a toilet 10, having a toilet bowl 12, having a rim 13, a bowl front 12F, a bowl rear 12R, and an area between the bowl front 12F and bowl rear 12R which may be generally designated as a bowl middle 12M. The toilet 10 also has a toilet seat 14, having a seat bottom 14B, a seat front 14F, a seat rear 14R, and an area between the seat front 14F and seat rear 14R which may be generally designated as a seat middle 14M. The toilet seat 14 is hingeably connected to the bowl 12 with a hinge 15 near both the seat rear 14R and the bowl rear 12R.

Also illustrated in FIG. 1, a seat lowering device 20 is mounted between the toilet seat 14 and toilet bowl 12, near the seat rear 14R and bowl rear 12R.

Referring now to FIG. 2, the seat lowering device 20 generally comprises a top plate 22 having a top plate front 22F and a top plate rear 22R, and a bottom plate 24 having a bottom plate front 24F and bottom plate rear 24R. An upper bracket 26 pivotally connects the top plate front 22F to the seat 14. A lower bracket 28 pivotally connects the bottom plate front 24R to the rim 13 of the bowl.

The lower bracket 28 comprises a U-clip 30 and a lower bracket hinge 32. The U-clip 30 prevents vertical movement with respect to the rim 13, and the lower bracket hinge 32 allows pivotal movement of the bottom plate 24 with respect to the U-clip 30, and thus with respect to the bowl.

The top plate 22 and bottom plate 24 are hingeably connected with a main hinge 25, located at the top plate rear 22R and bottom plate rear 24R. Bellows 40 are mounted between the top plate 22 and bottom plate 24. An internal cavity is defined by the bellows 40. In FIG. 2, the internal cavity of the bellows 40 are shown fully decompressed, wherein a distance between the top plate front 22F and bottom plate front 24F is minimal.

Also seen in FIG. 2 are three valves in direct communication with the internal cavity of the bellows 40. These three valves include a slow release valve 50, a quick intake valve 52, and a quick release valve 54.

Figure 3:
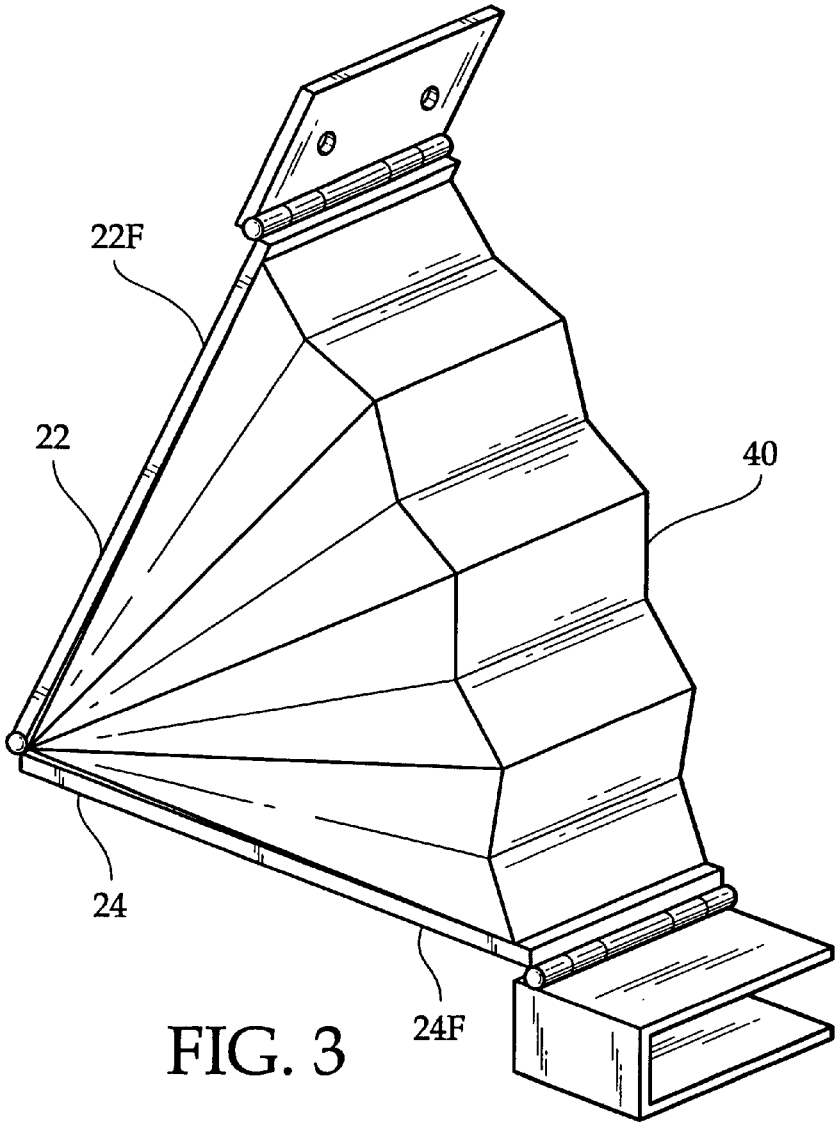
FIG. 3 is a diagrammatic perspective view of just the invention, with the bellows expanded.

Referring now to FIG. 3, the bellows 40 has been partially inflated by drawing air into the internal cavity thereof, thus increasing the distance between the top plate front 22F and bottom plate front 24F. The top plate 22 and bottom plate 24 now form an acute angle.

Figure 5:
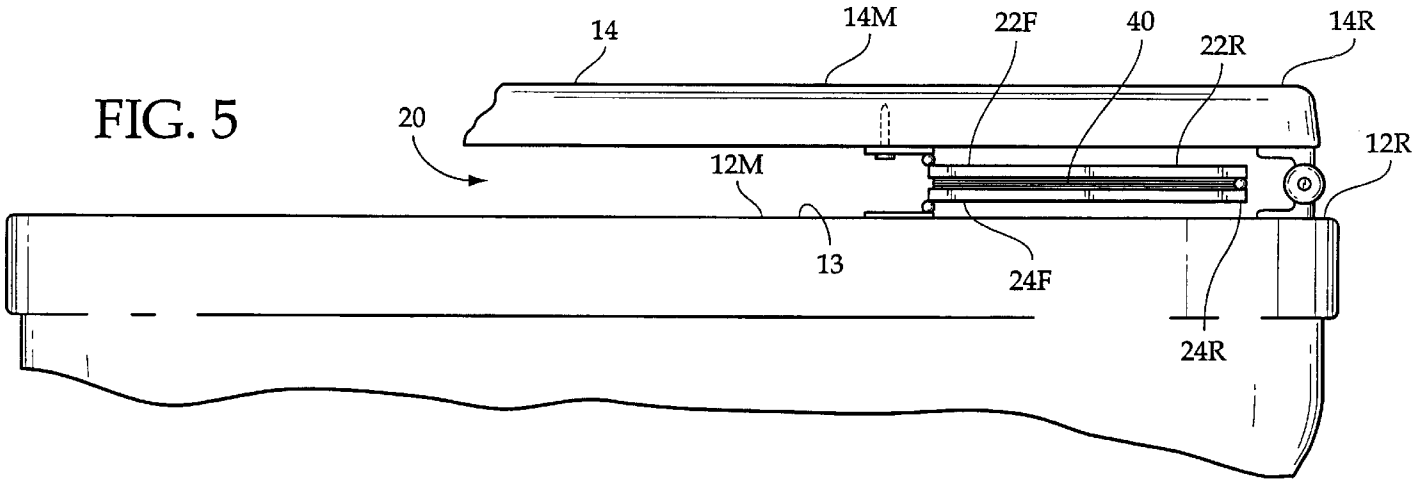
FIG. 5 is a side elevational view of the invention in use, wherein the seat is in the lowered position, and thus the bellows are fully deflated and depressurized.

Referring now to FIG. 5 the seat 14 is shown in a lowered position. Accordingly, the bellows 40 is fully decompressed. It is apparent in FIG. 5 that although the lowering device 20 is mounted near the seat rear 14R and extends thereto, there is no actual attachment to either the seat rear 14R or the bowl rear 12R. However, the top plate front 22F is mounted to the seat bottom 14B near the seat middle 14M. In addition, the bottom plate front 24F is mounted to the rim 13 of the bowl 12, near the bowl middle 12M. As previously indicated, the bottom plate rear 24R and the top plate rear 22R extend toward both the seat rear 14R and bowl rear 12R.

Figure 6:
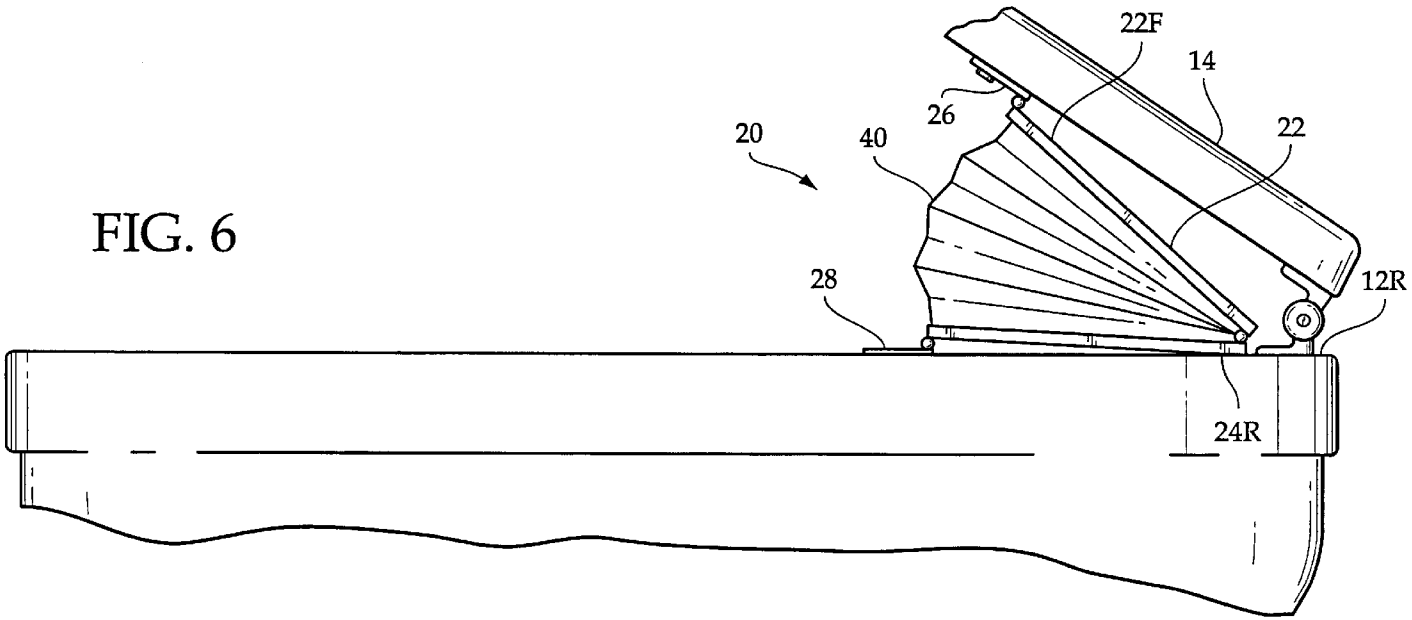
FIG. 6 is a side elevational view of the invention, wherein the seat is being raised such that air is being drawn in the internal cavity of the bellows.

Now, in FIG. 6, the seat 14 is being manually lifted, urging the bottom plate rear 24R downward against the bowl rear 12R, pulling upward upon the top plate 22 at the top plate front 22F, drawing air into the internal cavity of the bellows 40, and thus expanding the bellows 40. Note pivotal movement at both the upper bracket 26 and lower bracket 28 as the seat 14 is lifted. Such pivotal movement is essential to maintaining fluid motion of the seat 14, and proper following by the lowering device 20 of the seat motion.

Figure 7:
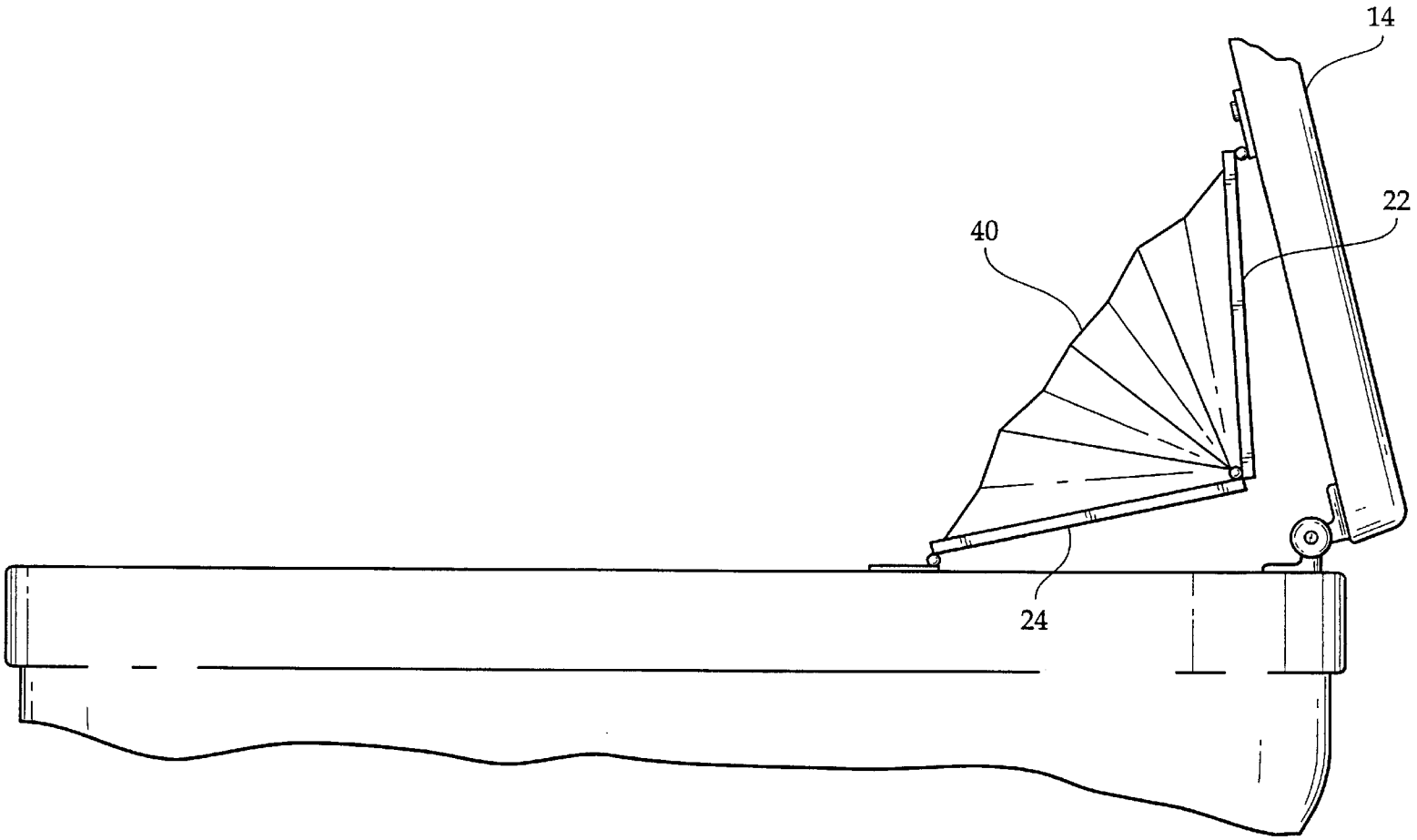
FIG. 7 is a side elevational view of the invention, wherein is seat is fully raised, and internal pressure within the bellows is holding the seat in the raised position.

In FIG. 7, the seat 14 has been fully raised, expanding the bellows 40 so that the top plate 22 and bottom plate 24 now form greater than a right angle. At this point, the seat 14 may be released by the user, exerting pressure upon the bellows 40, pressurizing the internal cavity of said bellows 40. The internal pressure of the bellows will maintain the seat 14 in its raised position. However, air leakage will slowly decrease pressure within the bellows, causing the distance between the top plate front 22F and bottom plate front 24F to minimize, and thus allowing the seat to fall.

Figure 4:
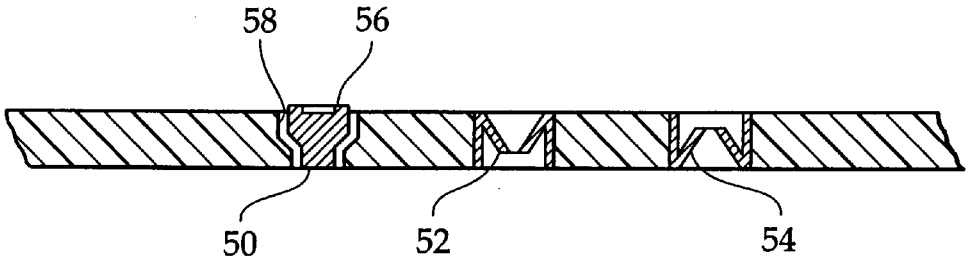
FIG. 4 is a cross sectional view, schematically illustrating the slow release valve, the quick intake valve, and the quick release valve.

However, air leakage is intentionally provided through the slow release valve 50, seen in FIG. 2. The slow release valve 50 is carefully calibrated and adjusted so as to time the lowering of the seat 14. A time period of several minutes is preferable, since it allows the male sufficient time to finish urinating, but will cause the toilet seat to restore to its lowered position within a reasonable amount of time thereafter. Referring to FIG. 4, the slow release valve 50 is schematically and illustratively shown having a slow release valve cavity 58 and a slow release valve body 56 mounted within said slow release valve cavity 58. By this example, it is apparent that simply adjusting the tightness of the valve body 56 within the valve cavity 58 will vary the degree of leakage through the valve cavity 58, and thus adjust the time period for air to leak from the bellows 40 and the seat 14 to fall to its lowered position. The valve body 56 and valve cavity 58 may be threaded, and the valve body slotted 56 as seen in FIG. 2, to facilitate adjustment.

In addition, if the user desires to lower the seat 14 before it naturally falls from leakage through the slow release valve 50, the quick release valve 54 comes into play. When downward pressure is exerted on the toilet seat 14 that is well beyond the typical weight of the toilet seat 14 itself, the quick release valve 54 will open, allowing air to rapidly escape from the internal cavity of the bellows 40, and thus allow the seat 14 to be quickly lowered manually.

Further, while the seat is raised, upward pressure from the user forces the intake valve 52 to open. Once open, the intake valve 52 allows air to rapidly enter the internal cavity of the bellows 40 with low resistance, so that the vacuum created by the expanding bellows does not unduly inhibit the raising of the seat 14. Both the intake valve 52 and the quick release valve 54 are one way "check" valves.

In conclusion, herein is presented a toilet seat lowering device which allows a toilet seat to be maintained in a raised position while the toilet is being used, and then slowly lowers the toilet seat to its lowered position after a short period of time.

What is claimed is:

1. A toilet seat lowering device, for use with a toilet seat having a raised position and a lowered position, a seat bottom, a seat front, a seat rear, and a seat middle, the toilet seat mounted to a toilet bowl having a bowl front, a bowl middle, and a bowl rear, the toilet seat rear pivotally connected at the toilet bowl rear with a hinge, comprising:

a top plate having a top plate front and a top plate rear, the top plate front for mounting to the toilet seat bottom near the seat middle with the top plate rear extending toward the seat rear;

a bottom plate having a bottom plate front and a bottom plate rear, the bottom plate rear pivotally attached to the top plate rear, the bottom plate front attachable to the toilet bowl middle with the bottom plate rear extending toward the bowl rear;

an inflatable bellows located between the top plate and bottom plate, defining an internal cavity which is inflatable to create a pressurized internal cavity, such that when said internal cavity is inflated a distance between the top plate front and bottom plate front is maximized to hold the toilet seat in the raised position; a quick intake valve in communication with the internal cavity of the bellows, so that the bellows automatically inflates when the toilet seat is manually raised; and a slow release valve in communication with the internal cavity of the bellows to allow controlled slow release of air from said internal cavity to slowly deflate the internal cavity, causing the distance between the top plate front and bottom plate front to minimize, thus lowering the toilet seat.

2. The toilet seat lowering device as recited in claim 1, wherein the bottom plate front is pivotally attachable to the toilet seat bottom near the seat middle.

3. The toilet seat lowering device as recited in claim 2, further comprising a lower bracket for attaching the bottom plate front to the bowl middle, the lower bracket having a u-shaped clip for attaching to the bowl middle and a lower bracket hinge for providing the pivotal attachment with the bottom plate front.

4. The toilet seat lowering device as recited in claim 3, wherein the top plate front is pivotally attachable to the seat middle.

5. The toilet seat lowering device as recited in claim 4, further comprising a quick release valve in communication with the internal cavity of the bellows, for opening upon abnormally high pressure within said internal cavity, so that said quick valve opens to release pressure within the internal cavity when downward manual pressure is applied to the seat for allowing the seat to be manually lowered quickly.

6. The toilet seat lowering device as recited in claim 5, wherein the slow release valve is adjustable, for adjusting the time period required for the internal cavity to depressurize and thus for the toilet seat to fall to its lowered position.

7. A toilet seat lowering method, for use with a toilet seat having a toilet seat front, a toilet seat rear, and a toilet seat bottom, the toilet seat mounted to a toilet bowl having a toilet bowl front and a toilet bowl rear, using a device comprising a top plate hinged to a bottom plate and bellows located therebetween, the bellows having an internal cavity capable of pressurizing, an intake valve in communication with the internal cavity, and a slow release valve in communication with the internal cavity, the device mounted near the bowl rear with the top plate attached to the seat bottom and the bottom plate attached to the bowl, comprising the steps of:

pressurizing the bellows by pulling air into the internal cavity through the intake valve by manually lifting the toilet seat to an upright position;

maintaining the toilet seat in the upright position by maintaining pressurization within the bellows; and lowering the toilet seat by releasing air from the bellows through the slow release valve.

* * * * *